US007913744B1

(12) United States Patent
Marti et al.

(10) Patent No.: US 7,913,744 B1
(45) Date of Patent: Mar. 29, 2011

(54) STRIP-CASTING MACHINE FOR PRODUCING A METAL STRIP AND A METHOD FOR CONTROLLING SAME

(75) Inventors: Heinrich Marti, Forch (CH); Jacques Barbé, Tarantaise (FR)

(73) Assignees: SMS Siemag Aktiengesellschaft, Düsseldorf (DE); Main Management Inspiration AG, Hergiswil (CH)

( * ) Notice: Subject to any disclaimer, the term of this patent is extended or adjusted under 35 U.S.C. 154(b) by 1607 days.

(21) Appl. No.: 10/110,004

(22) PCT Filed: Sep. 19, 2000

(86) PCT No.: PCT/EP00/09160

§ 371 (c)(1),
(2), (4) Date: Jul. 2, 2002

(87) PCT Pub. No.: WO01/26847

PCT Pub. Date: Apr. 19, 2001

(30) Foreign Application Priority Data

Oct. 8, 1999 (CH) ..... 1842/99

(51) Int. Cl.
*B22D 11/06* (2006.01)

(52) U.S. Cl. ..... 164/428; 164/480

(58) Field of Classification Search ..... 164/480, 164/428

See application file for complete search history.

(56) References Cited

U.S. PATENT DOCUMENTS 3,167,829 A 2/1965 Hess et al.
5,184,668 A 2/1993 Fukase et al.
5,277,243 A 1/1994 Fukase et al.
5,960,856 A * 10/1999 Blejde et al. ..... 164/480
6,164,366 A * 12/2000 Fish et al. ..... 164/480

FOREIGN PATENT DOCUMENTS

| | | | |
|---|---|---|---|
| DE | 2136146 | | 1/1972 |
| EP | 900607 | * | 3/1999 |
| JP | 60-145253 | * | 7/1985 |
| JP | 4-123852 | * | 4/1992 |

OTHER PUBLICATIONS

Patent Abstracts of Japan, vol. 018, No. 151 (M-1576), Mar. 14, 1994 & JP 05 329583 A (Mitsubishi Heavy Ind Ltd) Dec. 14, 1993.

* cited by examiner

*Primary Examiner* — Kuang Lin
(74) *Attorney, Agent, or Firm* — Lucas & Mercanti, LLP; Klaus P. Stoffel

(57) ABSTRACT

The invention relates to a strip-casting machine (20) for producing a metal strip (15). Said strip-casting machine comprises a pair of casting rolls (22, 24) which are arranged adjacent to each other, form a casting gap and are rotatably mounted on a machine tool table (32). The casting rolls (22, 24) and at least the machine tool table (32) carrying said rolls can be displaced on rails (48, 48') or the like from the casting position (G) into a waiting position (W) and vice versa. The machine tool table (32) together with the casting rolls (22, 24) can thereby be displaced away from the casting position (G) by such a distance that a second machine tool table (32) that is provided with prepared casting rolls (22, 24) can be displaced into the casting position (G). The machine tool table (32) is held in a displaceable manner and preferably together with a housing (30) which surrounds said table. The inventive strip-casting machine allows for quick maintenance or quick changing of the casting rolls and an increase in the casting performance thereof.

11 Claims, 3 Drawing Sheets

STRIP-CASTING MACHINE FOR PRODUCING A METAL STRIP AND A METHOD FOR CONTROLLING SAME

BACKGROUND OF THE INVENTION

1. Field of the Invention

The invention pertains to a strip-casting machine for producing a metal strip with two rotatably supported casting rolls set up next to each other to form a casting gap, where the casting rolls can be shifted away from the casting position to a servicing position and back again, and to a method for controlling the strip-casting machine.

2. Description of the Related Art

In strip-casting machines with two casting rolls, arranged essentially parallel to each other, side pieces are used to form the boundaries of the casting gap on the narrow sides. When strips, especially steel strips are cast, these side pieces are worn down by abrasive wear as a result of the friction with the casting rolls and also, in the lower part, by the friction with the solidified strip. When thus worn out, these side pieces must be replaced. So that they can be replaced, the side pieces are moved out of the casting position, in which they rest against the barrels, by means of the setting device in an essentially horizontal direction away from the barrels and into a setting position. Then side piece changing devices, e.g., robots, which are mounted on the casting platform on both sides of the machine, raise the side pieces up and out of the setting position. Japanese Patent Kokai JP-5[1993]-329,583 A, for example, describes robots of this type for replacing these side pieces.

In the known strip-casting machines, the casting rolls are stationary and are mounted rigidly underneath a ladle turret and a tundish vessel or the like. When these casting rolls must be serviced by regrinding or when they must be replaced, for example, a great deal of complicated disassembly and reassembly work is involved, because the casting rolls are difficult to access in themselves. Because of their weight, furthermore, they must be lifted away by a crane and set back into position again with an accuracy on the scale of millimeters. The connection and disconnection of the water lines or the electrical connecting lines is also associated with cumbersome work procedures because of the limited degree of accessibility present. It is even necessary to divide the structural frame on which the casting rolls are supported into two parts.

Another disadvantage of these known strip-casting machines is that, during the maintenance or servicing of the casting rolls or of the machine, no casting work can be done, which limits the casting output of the installation.

In a strip-casting machine of the general type in question according to WO-A 93/22,087, the casting rolls are supported on a cart, which can be moved along rails by a cylinder over a distance equal to approximately half the length of the cart. This design of the strip-casting machine, however, is suitable only for casting rolls of small diameter. The accessibility to the casting rolls in the servicing position a certain distance away from the casting position, furthermore, is still only slightly improved, because the rolls are still relatively close to the casting position.

SUMMARY OF THE INVENTION

The present invention was based on the task of creating a strip-casting machine of the general type described above in which optimum accessibility to the machine and especially to the casting rolls is made possible, as a result of which the rolls can be serviced or replaced rapidly, and in which the availability of the strip-casting machine for casting and thus the casting output of the installation can be increased.

The task is accomplished according to the invention in that the casting rolls can be shifted away from the casting position by a distance such that a second, prepared pair of casting rolls can be moved into the casting position.

With this design of the strip-casting machine according to the invention, in which the casting rolls can be shifted into a servicing position some distance away from the casting position and immediately replaced by another prepared set of casting rolls, considerable advantages are obtained in comparison with the known systems.

In an elaboration of the invention, it is provided that the casting rolls are supported rotatably on a structural frame; that the structural frame can be shifted away from the casting position by the distance indicated above; and that a second structural frame provided with prepared casting rolls can be shifted into the casting position.

By shifting the structural frame with the casting rolls to a servicing position, tools, gauges, finishing equipment, measurement and other control devices, etc., can be set up permanently at this location. This allows the machine to be maintained and serviced both quickly and also professionally. After a structural frame has been moved away to allow, for example, the casting rolls to be replaced with others of a different width or in cases where the casting rolls are no longer functional, newly prepared casting rolls on a different structural frame can be brought immediately into position underneath the tundish vessel, so that casting can begin again or continue.

BRIEF DESCRIPTION OF THE DRAWING

Exemplary embodiments of the invention and additional advantages of same are explained in greater detail below on the basis of the drawings.

DETAILED DESCRIPTION OF THE PREFERRED EMBODIMENTS

Figure 1:
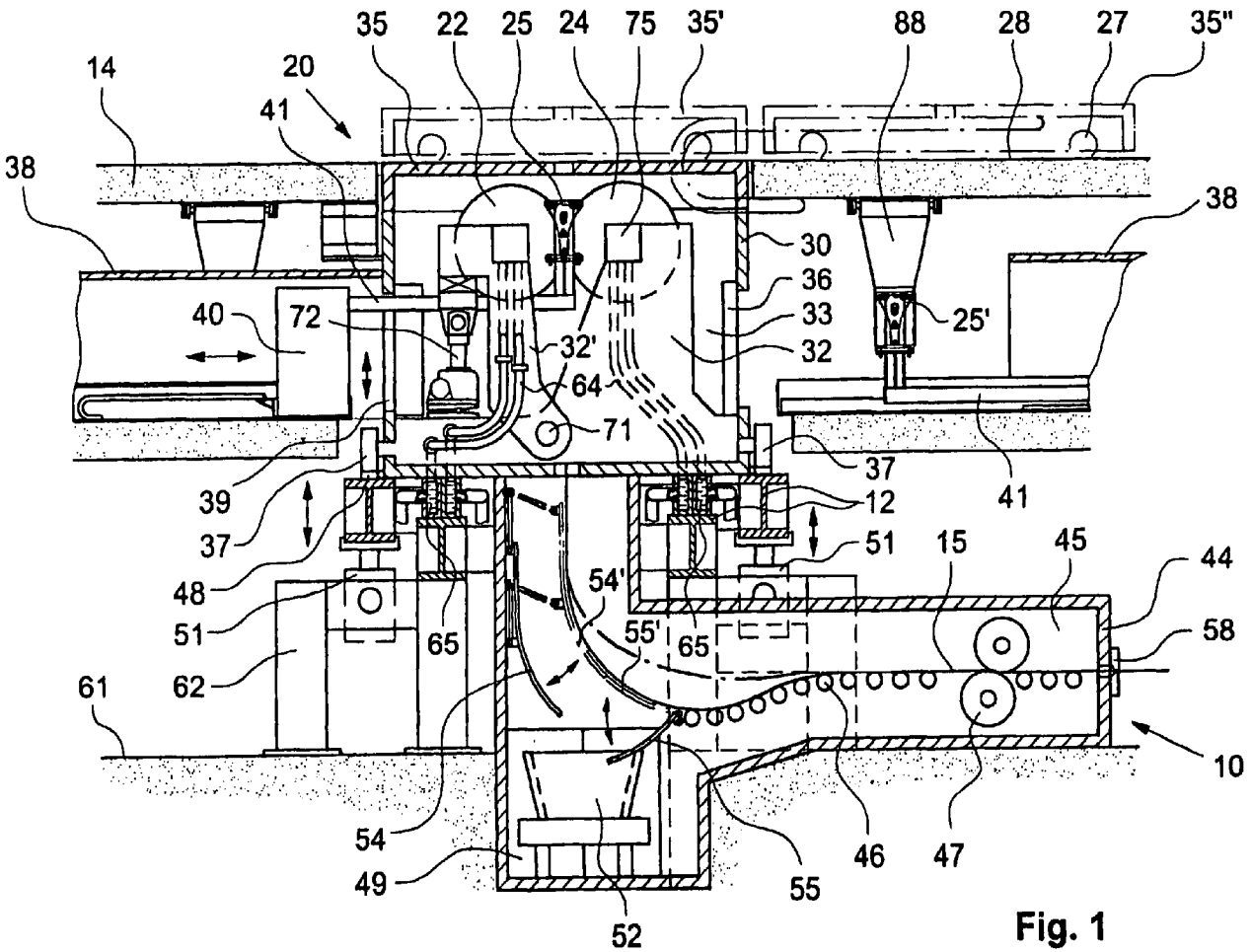
FIG. 1 is a schematic longitudinal section through a strip-casting machine according to the invention with a front view of the structural frame and of the casting rolls mounted on it.

FIG. 1 shows a strip-casting machine 20 of a casting installation 10 for metal strip 15, especially a steel strip, which can be produced in a continuous casting operation. This strip-casting machine 20 is supported on a carrier system 12 and is supplied with molten metal from a tundish vessel (not shown), located above it, as known from conventional strip-casting systems.

This strip-casting machine 20 consists primarily of two casting rolls 22, 24, essentially parallel to each other, the axes of which are approximately horizontal, and which are provided at each end with a lateral sealing element 25, as a result of which an enclosed space is created with a casting gap open at the bottom. The casting rolls 22, 24 are rotatably supported at each end on a structural frame 32, and each is driven in a controlled manner by its own motor. One of the parts 32' of the structural frame 32, 32' and the casting roll 22 belonging to it can be swung around an axis 71 by an adjusting means 72 for the purpose of adjusting the width of the casting gap.

Each of the casting rolls 22, 24 consists of a motor-driven cylindrical jacket and a stationary axle 75, on which the jacket is rotatably supported. Each of the axles 75 is supported at each end in the structural frame 32, 32'. This design with stationary axles 75 makes it possible to assemble the structural frame and the axles easily together into a unit.

The casting rolls 22, 24 in the structural frame 32 and the lateral sealing elements 25 are surrounded on all sides by a sealable housing 30. During the casting operation, the interior 33 of the housing is kept filled with a shielding gas, preferably an inert gas. It is highly advantageous for this box-shaped housing 30 to leave a certain gap between it and the casting rolls 22, 24 and the structural frame 32 both at the sides and also at the top.

A cover 35, which rests approximately horizontally on top of the housing 30, is provided; this cover can be shifted from the closed position shown to a raised position 35' and shifted horizontally away from this raised position to a position 35". For this purpose, the cover has rollers 27 on the sides, which travel along suitable rails 28. In the closed position shown, the cover 35 is advantageously lowered to the bottom level 14 to produce the desired seal of the housing 30.

The housing 30 also has openings 39, which can also be closed by doors 36; these openings are provided so that manipulators 40, which can travel outside the housing 30, can carry each of the lateral sealing elements 25 of the casting rolls 22, 24 away from the operating position shown, through the openings 39, and out of the housing 30 and back again. Each manipulator 40 has for this purpose a supporting arm 41, to which the lateral sealing element 25 is attached. The sealing element can thus be moved by the manipulator 40 from the operating position to a remote servicing position 25' and back again. In the operating position of the manipulator 40, it is possible to use a separate protective enclosure 38 to seal off the unsealed opening 39. This protective enclosure 38 surrounds the manipulator 40 and is pressed tight against the side of the housing 30. Also indicated are holders 88 for delivering and taking away the lateral sealing elements 25. It is advantageous to install two such manipulators 40 on each side of the housing 30 so that they can alternate in delivering the corresponding lateral sealing elements 25 to the end surfaces of the casting rolls 22, 24, after which they press the seals against the casting rolls with precise positioning during the casting operation.

Underneath the housing 30, the cast metal strip 15 is guided through an additional longitudinal housing 44, which forms a chamber 45, in which a shielding gas is also present to prevent the metal strip 15 from coming in contact with oxygen and thus especially to prevent scale formation. In this chamber 45, several rollers 46 and press rolls 47 are provided to guide the metal strip 15 through the longitudinal housing 44 and through a sealed opening 58 at one end. After it emerges from the housing 44, the metal strip can be, for example, rolled, cooled, coiled, or processed in some other way.

Underneath the opening 30", i.e., underneath the casting gap, furthermore, the longitudinal housing 44 has a pit 49 set into the installation floor 61, where a collecting tank 52 is provided. This collecting tank 52 has the job of preventing damage by catching the molten metal which can escape from between the casting rolls in the event of a leak. Above this tank 52 are pivoting clack valves 54, 55, which, in the position shown, leave an opening. When pivoted into the positions shown in dash-dot line, the flaps 54', 55' serve as a guide path for the metal strip 15.

The housing 30 has a feed line (not shown) for the injection of shielding gas into the interior 33; the gas can be sent around a circuit and cooled before being returned. Upon completion of the casting operation but before the housing is opened, the shielding gas can be drawn off into a storage tank, and the air in it can be filtered out if desired.

According to the invention, the casting rolls 22, 24 and at least the structural frame 32 supporting them are supported on rails 48 or the like so that they can be shifted from the casting position G shown to a servicing position W and back again. In the present exemplary embodiment, furthermore, the box-like housing 30 surrounding the structural frame 32 is also movable, for which purpose it has wheels 37, guided externally on the rails 48, 48'.

Figure 2:
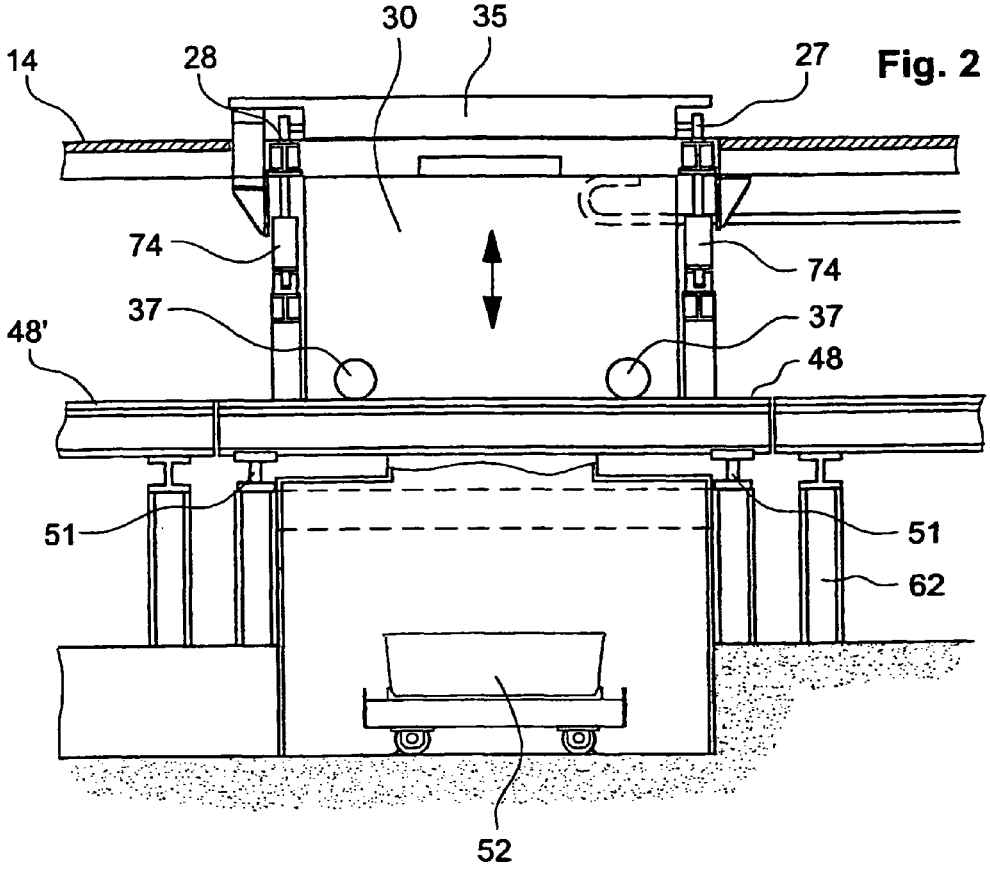
FIG. 2 is a section through the strip-casting machine according to FIG. 1.

As can be seen in FIG. 2 also, the rails 48, 48', which form a pair and carry the housing 30, have a section in the area of the casting position G which is separate from the rest of the length of the rails. This section is designed so that its height can be adjusted by lifting cylinders 51 or the like, which are attached to a structure 62. In FIG. 1, this section of the rails is shown in the lowered position together with the housing 30, whereas in FIG. 2 it is shown in the position in which it is aligned with the adjacent section of 48' of the rails. In the lowered position, the water feed lines 64 leading to the casting rolls 22, 24 are connected to the water supply system 65, which is provided in the housing floor. The water feed lines 64 are in the structural frame 32, whereas the water supply system 65 along with the appropriate feed and discharge lines extends underneath the housing 30. Thus the water lines 64 are connected and disconnected automatically upon actuation of the lifting cylinders 51. By means of nonreturn valves (not shown), the cooling water can be prevented from escaping when the lines are disconnected.

The lower contact surface of the cover 35 is underneath the floor 14 when the cover is in the lowered position, i.e., in the position where it seals off the housing, so that the housing can be shifted horizontally underneath the floor 14. As shown in FIG. 2, the cover is supported by its rollers 27 on the rails 28 as it is being moved and can be raised and lowered independently of the housing by lifting cylinders 74.

When the housing 30 is to be replaced, a new one with prepared casting rolls 30 is pushed into the casting position G and lowered. Then the lateral sealing elements 25 are pressed by the manipulators 40 against the end surfaces of the casting rolls 22, 24 with a defined pressure; the protective enclosures 38 and the cover 35 are connected tightly to the housing 30; and the interior of the housing is inertized by the shielding gas.

An additional advantage of the invention is that this replacement of the casting rolls 22, 24 can be carried out "on the fly", as it were; that is, the casting pipe, which passes through the cover 35 and projects between the casting rolls 22, 24, can be kept in position without the need to raise the tundish vessel 18 which holds it. During a replacement operation, the cover 35 is raised; the lateral sealing elements 25 are removed; and the casting rolls 22, 24 are rolled away from the housing 30 horizontally in the direction of their rotational axes. In a corresponding manner, the new casting rolls or casting rolls of a different width, for example, are brought up in such a way that the casting pipe assumes a position between them again but without actually contacting them. Thus casting can continue without the need to empty the tundish vessel 18. The only step which must be taken before casting can start again is to open the element which seals the outlet of the vessel. As a result, the output of the strip-casting machine according to the invention can be increased significantly.

Figure 3:
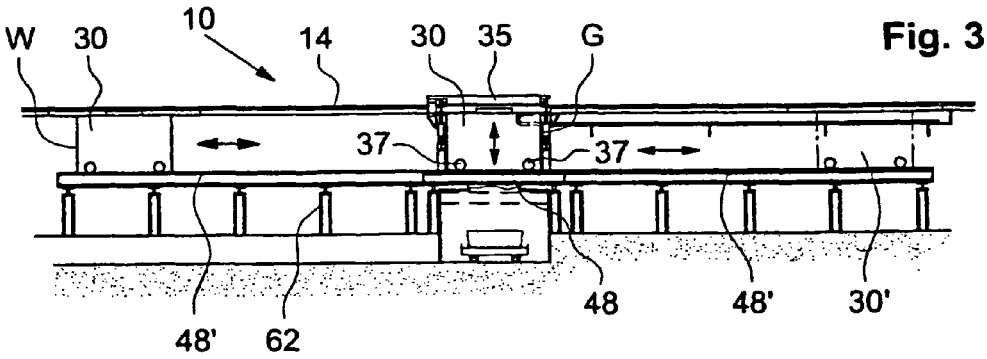
FIG. 3 is a section through the casting machine with illustration of the servicing positions of the casting rolls.

According to FIG. 3, the housing 30 is designed within the scope of the invention so that it can be moved along with the used casting rolls 22, 24 far enough away from the casting position G that a second housing 30' with prepared casting rolls can be conveyed into the casting position G. After reaching the casting position G, this housing 30' can be made ready for casting by lowering the rails 48 and thus connecting the lines 64 to the water supply system 65 and by closing the cover 35. It is advantageous for the distance between the casting position G and the servicing position W to be equal to several lengths of the housing or of the casting rolls, so that work can be carried out in the servicing position without interference from the casting operation. The exact distance depends on the circumstances of the individual casting installation.

Figure 4:
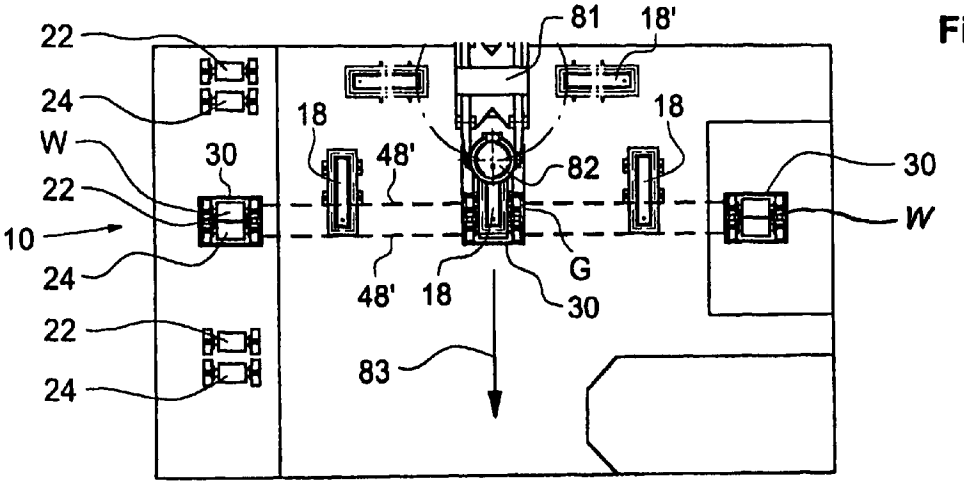
FIG. 4 id a schematic top view of the casting machine.

FIG. 4 shows a casting installation 10 which works with a single strand. A ladle turret 81 conventional in and of itself holds a ladle 82, from which the molten steel is poured into a tundish vessel 18. The molten steel then passes between the casting rolls located in the casting position G. The metal strip emerging at the bottom from between the two casting rolls is then conducted away in the direction of the arrow 83. In the servicing position W, the casting rolls 22, 24 are serviced by, for example, turning or grinding the surface or by some other type of surface treatment or are possibly replaced by new casting rolls as suggested in the figure. These casting rolls 22, 24 are pushed away together with their housing 30 along the rails 48'. The tundish vessels 18, 18' are also prepared for use. These could also be pivoted into the casting position by the ladle turret.

Figure 5:
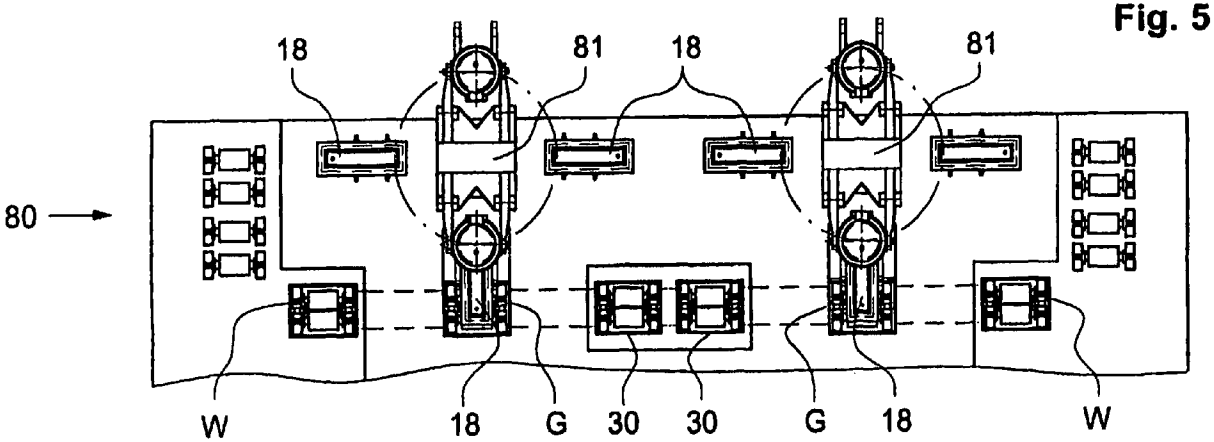
FIG. 5 is a schematic top view of a variant in the form of a twin-strand casting machine.

FIG. 5 shows a casting installation 80 with two strands, one next to the other, where, in contrast to the installation according to FIG. 4, two ladle turrets 81, each with its own servicing position W, are provided. In addition, two housings 30 with casting rolls 22, 24 are stationed between the casting positions G of the two strands; this location can also serve advantageously as a servicing position.

The invention could also be implemented to very great advantage in a twin-strand casting installation, in which two strands are supplied with molten metal by a tundish vessel with two outlet pipes. In this case, two housings, each with two casting rolls, would be used, one next to the other. An on-the-fly replacement could be accomplished here by replacing the one or other housing while casting continues with the other.

Instead of being positioned next to the casting rolls by manipulators 40, the lateral sealing elements could in principle be mounted on the structural frame and moved away into the servicing position along with the structural frame. The housing 30 could also remain in the casting position. In that case, only the structural frame, equipped with appropriate wheels, and the casting rolls would be moved away.

In principle, other means of moving the structural frame and the casting rolls such as, for example, suspension rails or an air-cushion bed could be used instead of rails.

The housing could also be guided along continuous rails without a section which can be lowered. The water line connections would in that case have to be designed as plug-in connections, as a media pressure plate, or the like.

The invention claimed is:

1. In a strip-casting machine for producing a metal strip including two rotatably supported casting rolls arranged next to each other to form a casting gap, wherein the casting rolls are movable between a casting position and a servicing position, and a sealable housing surrounding the casting rolls, the improvement comprising the casting rolls being movable together with the housing away from the casting position by a distance sufficient to allow a second prepared set of casting rolls to be moved into the casting position, wherein each of the casting rolls is comprised of a stationary axle and a motor-driven cylindrical jacket rotatably mounted on the axle and each casting roll being driven in a controlled manner by a separate motor, each stationary axle being supported at an end thereof in a structural frame, and wherein the casting rolls and the structural frames are surrounded by the sealable housing, further comprising means for moving the structural frame and the casting rolls, wherein the structural frame is moveable away from the casting position by said distance.

2. The strip-casting machine according to claim 1, wherein the housing comprises wheels which travel on rails.

3. The strip casting machine according to claim 2, wherein the rails include a rail section in an area of the casting position, wherein the rail section is configured to be raisable and lowerable by lifting cylinders, such that the housing can be raised or lowered into the casting position, and that the rails can be lowered and raised into a position in which the rail section is in alignment with adjacent rails.

4. The strip-casting machine according to claim 3, comprising water feed lines to the casting rolls, wherein the water feed lines are configured to be connected and disconnected by lowering and raising the housing, wherein the water feed lines are contained in a structural frame, and wherein a stationary water supply system with supply lines is mounted underneath or outside the housing.

5. The strip-casting machine according to claim 1, wherein the housing comprises a cover, further comprising additional lifting cylinders for raising and lowering the cover independently of the housing.

6. The strip-casting machine according to claim 1, wherein the distance between the casting position and the servicing position is equal to several times a length of the housing or of the casting rolls.

7. The strip-casting machine according to claim 1, further comprising servicing equipment in the servicing position for cleaning the casting rolls, turning outside diameters of the casting rolls and renewing surfaces of the casting rolls without dismantling the casting rolls.

8. The strip-casting machine according to claim 1, comprising lateral sealing elements mounted on both sides of the casting rolls, and a manipulator each for moving the lateral sealing elements out of the housing and into the housing against end surfaces of the casting rolls.

9. The strip-casting machine according to claim 8, wherein each manipulator is mounted so as to move together with the housing.

10. The strip-casting machine according to claim 1, for use in a multi-strand casting installation with at least one additional adjacent strip-casting machine, wherein the strip-casting machines are supplied with molten metal from a single tundish vessel, and wherein the housings are configured such that one of the housings with the casting rolls can be replaced by a new housing with casting rolls, while another of the housings remains in operation.

11. The strip-casting machine according to claim 10, wherein the adjacent strip-casting machines have a common servicing position.

* * * * *